United States Patent [19]

Kusakabe

[11] 4,404,432

[45] Sep. 13, 1983

[54] STEREO IDENTIFYING SIGNAL DETECTION DEVICE

[75] Inventor: Hiromi Kusakabe, Yokohama, Japan

[73] Assignee: Tokyo Shibaura Denki Kabushiki Kaisha, Kawasaki, Japan

[21] Appl. No.: 299,482

[22] Filed: Sep. 4, 1981

[30] Foreign Application Priority Data

Sep. 10, 1981 [JP] Japan ..... 55-125777

[51] Int. Cl.[3] ..... H04H 5/00

[52] U.S. Cl. ..... 179/1 GS; 179/1 GN

[58] Field of Search ..... 179/1 GN, 1 GS

[56] References Cited

U.S. PATENT DOCUMENTS 4,170,716 10/1979 Hilbert et al. ..... 179/1 GS 4,249,039 2/1981 Fisher et al. ..... 179/1 GN X 4,344,038 8/1982 Streeter ..... 179/1 GS X

*Primary Examiner*—R. J. Hickey

*Attorney, Agent, or Firm*—Cushman, Darby & Cushman

[57] ABSTRACT

A stereo identifying signal detection device, with a circuit for phase detecting a received stereophonic broadcast signal and detecting a stereo identifying signal, an exclusive OR circuit for generating a pulse for every cycle period of the detected stereo identifying signal, and a control circuit for integrating the pulse signal thus generated to obtain a DC voltage used to turn on a stereo receiving state indicating lamp.

3 Claims, 4 Drawing Figures

STEREO IDENTIFYING SIGNAL DETECTION DEVICE

BACKGROUND OF THE INVENTION

This invention relates to a device, which is assembled in a stereophonic broadcast receiver for detecting an identifying signal indicating that the received broadcast wave is a stereophonic broadcast wave (hereinafter referred to as stereo identifying signal) from the received broadcast signal.

As the well-known stereophonic broadcast system, there is an AM stereophonic broadcast system based on the Magnavox system. The transmission signal in the Magnavox system is expressed as $$E(t)=[1+m\{L(t)+R(t)\}]\cos[\omega_c t+B\{L(t)-R(t)+A\cos\omega_0 t\}] \quad (1)$$

where L(t) and R(t) are left and right channel signals, n is the degree of AM modulation, B is the index of PM modulation which is equal to ±1 rad. max, A is the index of FM modulation (amplitude component of the identifying signal), $\omega_0$ is equal to $2\pi f$ (f=5 Hz) and $\omega_c$ is equal to $2\pi$ (carrier frequency).

In the equation (1), A cos $\omega_0 t$ represents the stereo identifying signal component. It will be seen that this component is produced as a result of FM modulation of the carrier wave. The stereo identifying signal is modulated by a frequency of 5 Hz, and the frequency deviation of the carrier wave by the modulation is set to 0 to ±20 Hz. The FM modulation may also be thought as a phase modulation, and the deviation of the phase modulation is ±20÷5=±4 (rad.). The receiver is set either in a stereophonic or monophonic receiving mode depending upon whether such a stereo identifying signal is contained in the received broadcast signal. When receiving the broadcast wave, the receiver is desired to provide quick response and reliable action of switching between the stereophonic and monophonic receiving modes. However, in the broadcast system mentioned it is considerably difficult to let the receiver reliably and quickly respond to the stereophonic broadcast. This is because of the facts that the frequency of the stereo identifying signal is very low, namely 5 Hz, and also very large DC level variations are introduced into the demodulated output at the time of the tuning operation due to an S-shaped characteristic of the detector.

SUMMARY OF THE INVENTION

An object of the invention, accordingly, is to provide a stereo identifying signal detecting device, which can reliably and quickly detect the stereo identifying signal.

According to the invention, this object is attained by a stereo identifying signal detection device, which comprises means for extracting the stereo identifying signal from the received broadcast signal, means for limiting the level of the extracted stereo identifying signal, means for generating a pulse signal in response to a predetermined variation of the output signal level of the limiting means, and means for integrating the pulse signal, the output signal of the integrating means being used to switch the receiver between stereophonic and monophonic receiving modes.

DETAILED DESCRIPTION OF THE PREFERRED EMBODIMENT

Figure 1:
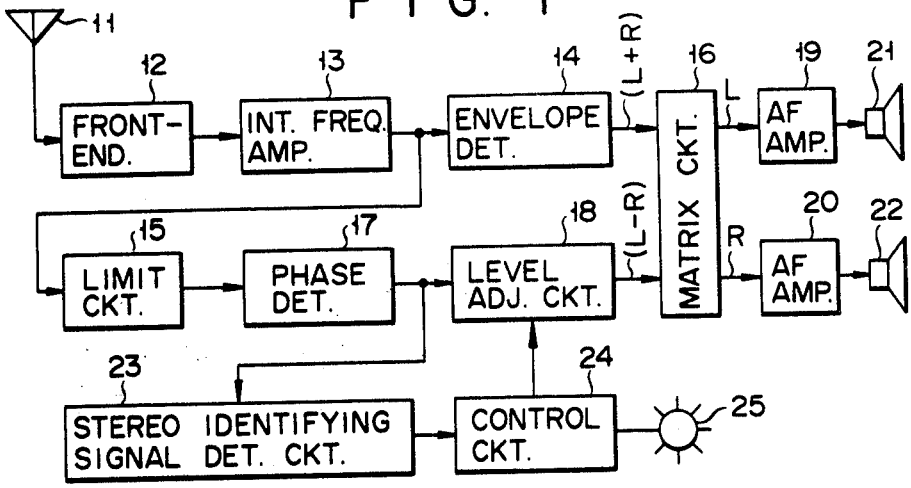
FIG. 1 is a block diagram showing an AM stereophonic receiver embodying the invention.

Referring now to FIG. 1, a broadcast signal intercepted by an antenna 11 is coupled to a front-end 12 which has such functions as high frequency amplification and tuning. The tuned high frequency broadcast signal output of the front-end 12 is then converted by an intermediate frequency amplifier 13 into an intermediate frequency signal, which is coupled to an envelope detector 14 and a limiter circuit 15. The envelope detector 14 provides the sum combination (L+R) of the left and right channel signals L(t) and R(t) in the equation (1) as the detection output signal. The detection output signal (L+R) is coupled to one of two input terminals of a matrix circuit 16.

The limiter circuit 15 limits the amplitude intermediate frequency signal input to leave only the FM component, which is coupled to a phase detector 17 for phase detection. The phase detector 17 provides an output signal (L−R), which is coupled to a level adjustment circuit 18 for level adjustment before being coupled to the other one of the input terminals of the matrix circuit 16. The matrix circuit 16 reproduces the left and right channel signals L and R from the input signals (L+R). The left and right channel signals L and R thus reproduced are respectively coupled through AF amplifiers 19 and 20 to left and right channel loudspeakers 21 and 22.

The phase detection output signal of the phase detector 17 is also coupled to a stereo identifying signal detection circuit 23. The stereo identifying signal detection circuit 23 extracts the stereo identifying signal from the detection output. The detected stereo identifying signal is coupled to a control circuit 24. The control circuit 24 detects the level of the stereo identifying signal. When the detected level is above a predetermined level, the control circuit 24 supplies a signal identifying that the received broadcast wave is a stereophonic broadcast wave to an indicating lamp 25 to turn on the lamp. At this time, it also supplies a control signal to the level adjustment circuit 18 to control the output signal (L−R) of the phase detector 17 to the same level as the output signal (L+R) of the envelope adjustment circuit 18. When the received broadcast wave is detected to be a monophonic broadcast wave, the control circuit 24 supplies no lamp drive signal to the indicating lamp 25. Also, it causes the level adjustment circuit 18 to set the level of the signal (L−R) supplied from the phase detector 17 to the matrix circuit 16 to zero.

Figure 2:
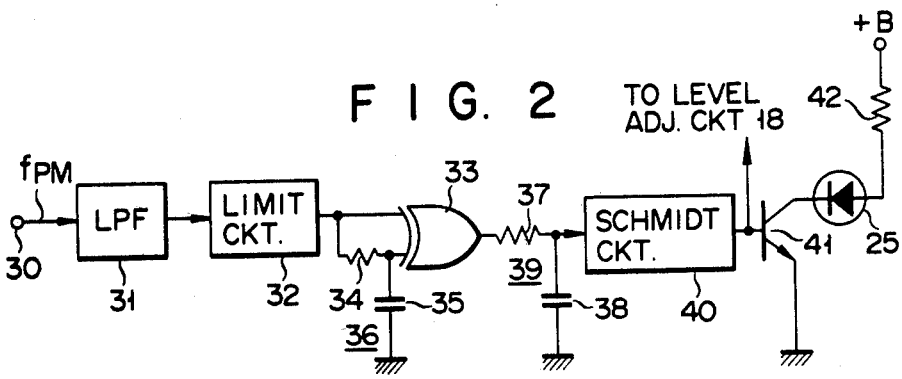
FIG. 2 is a block diagram of an embodiment of the stereo identifying signal detection device according to the invention.

Now, the detailed construction and operation of the stereo identifying signal detection circuit 23 and control circuit 24 in FIG. 1 will be described with reference to FIGS. 2 and 3. Referring now to FIG. 2, the phase detection output signal $f_{PM}$ is coupled from the phase detector 17 in FIG. 1 to an input terminal 30. The signal $f_{PM}$ goes to a low-pass filter 31, in which frequency components for voice or the like which are high compared to the 5-Hz stereo identifying signal are removed. The filter 31 thus provides a stereo identifying signal, which has a waveform as shown in (a) in FIG. 3. The stereo identifying signal level greatly varies due to variations of the output of the front-end 12 known as an S-shaped curve which accompanies the tuning operation in a tuner provided in the front-end. Accordingly, the output of the low-pass filter is coupled to a limiter circuit 32 for limiting it to a predetermined level. The output of the limiter circuit 32 has a waveform as shown in (b) in FIG. 3. Here, the level variations of the stereo identifying signal is suppressed.

The output of the limiter circuit 32 is coupled directly to one of input terminals of an exclusive OR circuit 33, while it is also coupled through a delay circuit 36 constituted by a resistor 34 and a capacitor 35 to the other input terminal of the exclusive OR circuit 33. The output signal of the delay circuit 36 has a waveform as shown in (c) in FIG. 3. The threshold voltage $V_{TH}$ in the logic operation of the exclusive OR circuit 33 is set to a level as shown in (c) in FIG. 3, and the output of the exclusive OR circuit 33 thus has a pulse waveform as shown in (d) in FIG. 3.

This pulse signal is coupled to an integrating circuit 39 which is constituted by a resistor 37 and a capacitor 38. The integrating circuit 39 generates a DC voltage proportional to the input pulse rate and width as shown in (c) in FIG. 3. This DC voltage is coupled to a Schmidt circuit 40. The Schmidt circuit 40 provides output signal while the level of the input DC voltage is, for instance, above Va as shown in (e) in FIG. 3, and it corresponds to the control circuit 24 in FIG. 1. When this output signal is provided to the base of a transistor 41, the transistor 41 is turned on to cause current from a voltage supply terminal +B through a resistor 42 and a photodiode 25, thus causing light emission therefrom. The light emission of the photodiode 25 indicates that the receiver is receiving a stereophonic broadcast wave. The output of the Schmidt circuit 40 is also coupled to a control terminal of the level adjustment circuit 18 in FIG. 1. The level adjustment circuit 18 may also have a function as a switch circuit. When the output from the Schmidt circuit 40 is provided, the switch in the level adjustment circuit 18 is turned on to permit the signal (L−R) to be coupled to the matrix circuit 16. When a monophonic broadcast wave is received, the Schmidt circuit 40 provides no output to hold "off" the switch in the level adjustment circuit 18, and thus the output of the phase detector 17 is not coupled to the matrix circuit 16.

Figure 3:
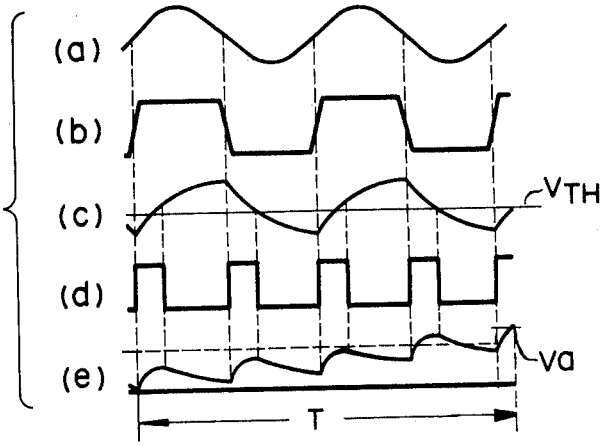
FIG. 3 is a signal waveform chart useful in explaining the operation of the device of FIG. 2.

The light emission of the photodiode 25, indicating that a stereophonic broadcast wave is being received, is caued after a period T as shown in (e) in FIG. 3, for instance, from the instant when the tuner in the front-end 12 was tuned to the stereophonic broadcast wave. The period T here is 0.4 sec. because it covers two cycles of the 5-Hz stereo identifying signal shown in (a) in FIG. 3. This period of 0.4 sec. is very short so that the indicating lamp 25 is apparently turned on when the tuner is tuned to the stereophonic broadcast wave.

Figure 4:
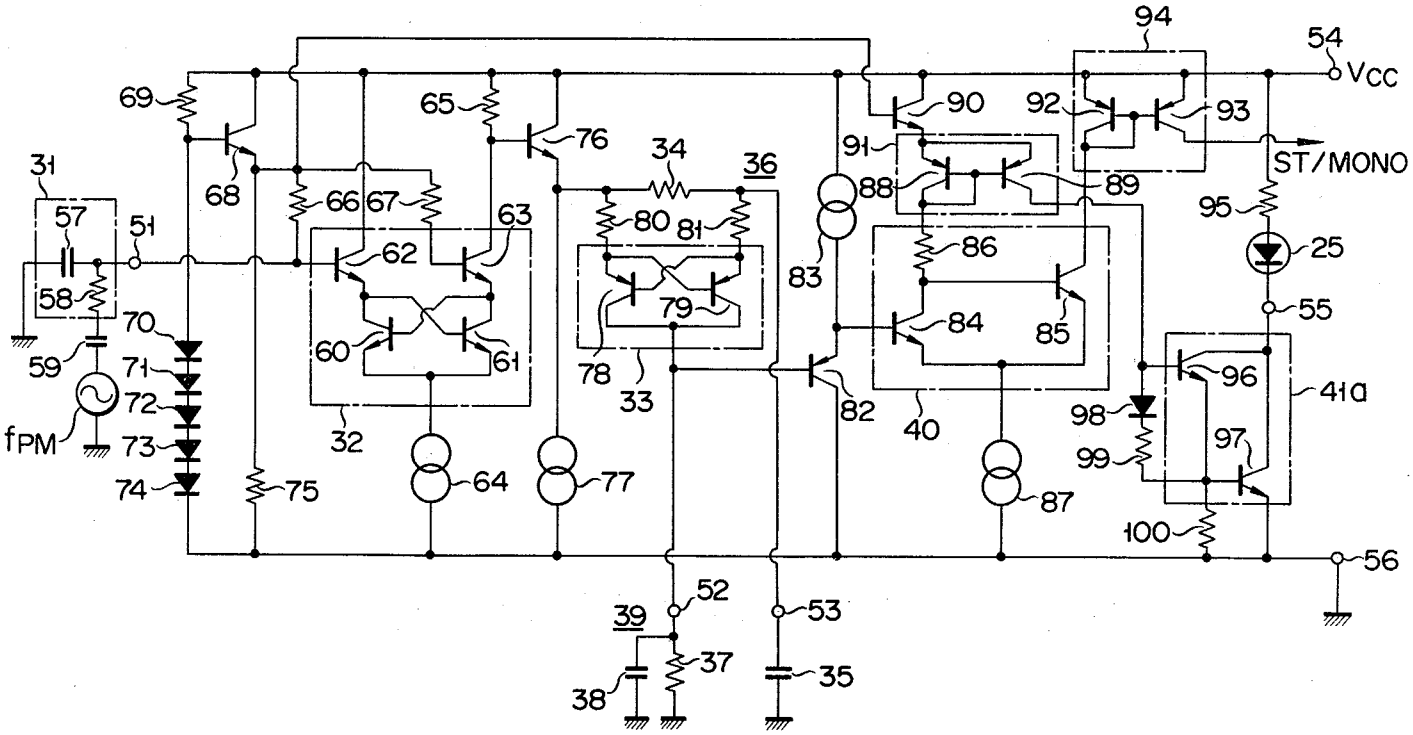
FIG. 4 is a circuit diagram showing a specific circuit construction of the embodiment of FIG. 2.

Now, a specific detailed example of the circuit of FIG. 2 will be described with reference to FIG. 4. Like parts as in FIG. 2 are designated by like reference numerals. This circuit is an integrated circuit and provided with connection terminals 51 to 56 for connection to external circuits. Of these terminals, the terminal 54 is connected to a voltage supply $V_{CC}$, and the terminal 56 is grounded. The low-pass filter 31 includes a capacitor 57 and a resistor 58, which are connected at one end to the terminal 51. The other terminal of the capacitor 57 is grounded, and the other terminal of the resistor 58 is connected to one terminal of a capacitor 59. The output signal $f_{PM}$ of the phase detector 17 is coupled between the other terminal of the capacitor 59 and ground. The limiter circuit 32 includes transistors 60 to 63. The transistor 62 has its base connected to the terminal 51 mentioned above, its emitter connected to the collector of the transistor 60 and also to the base of the transistor 61 and its collector connected to the terminal 54 mentioned above. The transistor 61 has its emitter connected to the emitter of the transistor 60 and also connected through a current source 64 to the terminal 56 mentioned above and its collector connected to the base of the transistor 60 and also to the emitter of the transistor 63. The collector of the transistor 63 is connected through a resistor 65 to the terminal 54. The transistors 62 and 63 have their bases connected through respective resistors 66 and 67 to the emitter of a transistor 68. The collector of the transistor 68 is connected to the terminal 54 and also connected through a resistor 69 to its base. The base of the transistor 68 is also connected through diodes 70 to 74 in series to the terminal 56 mentioned above. The emitter of the transistor 68 is connected through a resistor 75 to the terminal 56. The transistor 63 has its collector also connected to the base of a transistor 76. The transistor 76 has its emitter connected through a current source 77 to the terminal 56 and its collector connected to the terminal 54.

The exclusive OR circuit 33 includes transistors 78 and 79. The transistor 78 has its emitter connected through a resistor 80 to the emitter of the transistor 76 and its collector connected to the collector of the transistor 79. The transistor 79 has its base connected to the emitter of the transistor 78 and its emitter connected to the base of the transistor 78 and also connected through resistors 81 and 34 to the emitter of the transistor 76. The transistors 78 and 79 have their collectors commonly connected to the terminal 52 mentioned above. The resistor 37 and capacitor 38 in the integrating circuit 39 are connected in parallel between the terminal 52 and ground. The juncture between the resistors 81 and 34 is connected to the terminal 53 mentioned above, and the terminal 53 is grounded through the capacitor 35. The common collector junction of the transistors 78 and 79 is connected to the base of a transistor 82. The transistor 82 has its collector connected to the terminal 56 and its emitter connected through a current source 83 to the terminal 54.

The Schmidt circuit 40 includes transistors 84 and 95 and a resistor 86. The transistor 84 has its base connected to the emitter of the transistor 82 and its collector connected to one end of the resistor 86 and also to the base of the transistor 85. The transistor 85 has its emitter connected to the emitter of the transistor 84 and also connected through a current source 87 to the terminal 56. The other terminal of the resistor 86 is connected to the collector of a transistor 88. The transistor 88 has its collector connected to its base and also to the base of a transistor 89. The transistor 89 has its emitter connected to the emitter of the transistor 88 and also to the emitter of a transistor 90. The transistor has its base connected to the emitter of the transistor 68 and its collector connected to the terminal 54. The transistors 88 and 89 constitute a current mirror 91. The transistor 85 has its collector connected to a current mirror 94, which includes transistors 92 and 93. More particularly, the collector of the transistor 85 is connected to the collector of the transistor 92. The transistor 92 has its collector connected to its base and also to the base of the transistor 93. The emitters of the transistors 92 and 93 are connected to the terminal 54. From the collector of the transistor 93, the control signal of the level adjustment circuit 18 in FIG. 1 appears. A resistor and the stereo indication photodiode 25 are connected in series between the terminals 54 and 55. To the terminal 55 mentioned above are connected the collectors of transistors 96 and 97. The base of the transistor 96 is connected to the collector of the transistor 89 and also connected through a diode 98 and a resistor 99 to its emitter and to the base of the transistor 97. The base of the transistor 97 is connected through a resistor 100 to the emitter of the transistor 97 and the terminal 56. The transistors 96 and 97 constitute a stereo indicator drive circuit 41*a*.

In the above construction, the low-pass filter 31 derives the stereo identifying signal appearing at the terminal 51 from the phase detection output signal $f_{PM}$. This stereo identifying signal is coupled to the limiter 32. In the limiter circuit 32, the collectors of the transistors 60 and 61 are connected to the bases of the other transistors to provide DC positive feedback. The loop gain of the positive feedback loop of the transistors 60 and 61 may be made substantially unity by selecting the resistances of the resistors 66 and 67 to be sufficiently low. The load impedance of the transistors 60 and 61 looked from the emitters of the transistors, is expressed respectively as $$R_{E5}=(V_T/I_{E3})+(R_{66}/\beta)$$

and $$R_{E4}=(V_T/I_{E3})+(R_{67}/\beta)$$

(where $R_{66}$ is the resistance of the resistor 66, $T_{E1}$ and $T_{E2}$ are emitter currents through the respective transistors 62 and 63, and $R_{67}$ is the resistance of the resistor 67). As the resistance of the resistors 66 and 67 increase, the second term of this impedance becomes noticeable. Thus, with the increase of the resistances of the resistors 66 and 67 the loop gain eventually becomes greater than unity so that the limiter circuit 32 shows a hysteresis characteristic. For the limiter, the presence of hysteresis gives rise to no problem. Experiments prove that satisfactory results could be obtained with the resistances of the resistors 66 and 67 set to several hundred to several kiloohms. The limiter circuit 32 provides a high gain even if it is provided as a single stage and the sufficient limiter effects with respect to input signals of even about 10 millivolts. The output signal of the limiter circuit 32 appears across the resistor 65 and is coupled through the transistor 76, which serves as an impedance conversion emitter follower, to the exclusive OR circuit 33. The limited stereo identifying signal output (which is substantially a rectangular wave as shown in (b) in FIG. 3), is coupled through the resistor 80 to the transistors 78 and 79 without substantial change of its waveform. It is also delayed with the time constant of the circuit formed by the resistor 34 and capacitor 35 and then coupled through the resistor 81 to the transistors 78 and 79. Since the emitters of the transistors 78 and 79 are connected to the bases of the other transistors, only when their emitter or base potential difference exceeds $V_{BE}$, one of these transistors 78 and 79 is turned on to provide output current from the collector. The capacitor 38 connected to the terminal 52 serves to reduce ripple superimposed upon the DC voltage. If its capacitance is excessive, the response to the stereo identifying signal is slow. If its capacitance is insufficient, ripple is not sufficiently reduced, giving rise to blinking of the stereo indication light or instability of the automatic stereo/monoural switching action. The resistor 37 serves to determine the DC potential at the terminal 52. The DC potential $V_{DC}$ on the terminal 52 is given as $$V_{DC}=R_{37}\cdot I_{ex}$$

where $I_{ex}$ is the average current in the exclusive OR circuit 33 and $R_{37}$ is the resistance of the resistor 37. The output of the exclusive OR circuit 33, which serves as a buffer and level shift transistor, to the Schmidt circuit 40. In the Schmidt circuit 40, DC positive feedback is provided with the common emitter connection of the transistors 84 and 85. The depth of hysteresis is determined by the product $R_{86}\cdot I_{87}$ of the resistance $R_{86}$ of the resistor 86 and the current $I_{87}$ through the current source 87. When the DC potential at the terminal 52 is increased beyond the threshold level of the Schmidt circuit 40, the transistor 84 is turned on to actuate the stereo indicator drive circuit 41*a* through the current mirror circuit 91, thus turning on the photodiode 25. At the same time, the transistor 85 is turned off to cut off the switching current having been supplied through the current mirror circuit 94. In this way, the level adjustment circuit 18 is controlled to a stereo receiving state.

With the above construction, the potential variations at the time of the tuning operation that constitute a prime cause of malfunction are all rendered to the same level by the limiter circuit 32. In addition, the delay circuit 36 constituted by the resistor 34 and capacitor 35 and exclusive OR circuit 33 function to provide a single pulse for each potential variation cycle on the limiter circuit 32 (see (d) in FIG. 3), and this pulse output can be very well distinguished from the pulse series of the stereo identifying signal, thus permitting reliable detection of the stereo identifying signal. Further, with the exclusive OR circuit 33 used, pulses can be obtained at both the rising and falling points of the waveform, and this is equivalent in effect to the action of full-wave rectification. Thus, the response speed can be doubled compared to the case where an ordinary gate circuit is used. While the exclusive OR circuit is usually a differential circuit of double-balanced type using four transistors, in the above embodiment only two transistors 78 and 79 are used, and the construction is simplified.

By way of example, in the usual case where quadrature detection and integrating amplifier are combined, the DC voltage variation arising at the time of the tuning operation are several volts, and its ratio with respect to the stereo identifying signal level which is several to several ten millivolts in 40 to 60 dB, which is tremendously great. In addition, the DC voltage variations often have substantially the same instantaneous frequency as frequency of the stereo identifying signal, and in this case their removal with an ordinary filter is difficult.

Further, since the limiter circuit 32 has a high gain even in a single state, it provides sufficient limiter effects with respect to input signals of the order of 10 millivolts. Further, only a single current source is needed, the current required for the operation is low, and the circuit construction is comparatively simple, which is desirous from the standpoint of cost reduction. Further, the properties of pair transistors such as transistors 60 and 61 or transistors 62 and 63 are necessary for the stable operation of the circuit, and from this viewpoint a monolithic integrated circuit is particularly suitable according to the invention.

Further, it is possible to connect impedance elements such as resistors or diodes to the emitters of the transistors 60 and 61. When diodes are inserted, the loop gain of the transistors 60 and 61 are roughly $\frac{1}{2}$.

Further, while in the above embodiment the stereo identifying signal has been coupled to the base of the transistor 62, this is by no means limitative; for instance, the signal may be coupled to the base of the transistor 63 or the base of the transistor 66 or 67 as well.

Further, the invention can be applied not only to the detection of the stereo identifying signal in the system, but it may also be effectively utilized as a method of detection of frequency or phase modulated signals at frequencies lower than the audio frequency range.

Further, the DC integrating means may be replaced with a counter, a shift register or other means which digitally provide equivalent function.

As has been described in the foregoing, according to the invention it is possible to provide a stereo identifying signal detection device, which is free from malfunction and can quickly detect the stereo identifying signal.

What is claimed is:

1. A stereo identifying signal detection device comprising means for extracting a stereo identifying signal from a received broadcast signal, means for limiting the level of the extracted stereo identifying signal, means for generating a pulse signal according to predetermined level variations of the output signal from said limiting means, and means for integrating said pulse signal, the output signal from said integrating means being used to switch a receiver between stereophonic and monophonic receiving modes.

2. A stereo identifying signal detection device according to claim 1, wherein said pulse signal generating means includes means for delaying the output of said limiting means, a first input terminal, to which the output of said limiting means is directly coupled, and a second input terminal, to which the output of said delaying means is coupled.

3. The stereo identifying signal detecting device according to claim 2, wherein said means for generating a pulse signal includes an exclusive OR circuit with a first and a second transistor each having collector, an emitter and a base, the emitter of said first transistor and the base of said second transistor being commonly connected to said first input terminal, the emitter of said second transistor and the base of said first transistor being commonly connected to the output terminal of said delaying means.

* * * * *